United States Patent [19]

Yokoo

[11] Patent Number: 4,912,438

[45] Date of Patent: Mar. 27, 1990

[54] ELECTROMAGNETIC RELAY

[75] Inventor: Kiyotaka Yokoo, Tokyo, Japan

[73] Assignee: NEC Corporation, Japan

[21] Appl. No.: 260,243

[22] Filed: Oct. 20, 1988

[30] Foreign Application Priority Data

Oct. 22, 1987 [JP] Japan ..... 62-267801
Apr. 28, 1988 [JP] Japan ..... 63-108646

[51] Int. Cl.[4] ..... H01H 51/22
[52] U.S. Cl. ..... 335/78; 335/84
[58] Field of Search ..... 335/78, 79, 80, 81, 335/82, 83, 84, 85, 86

[56] References Cited

U.S. PATENT DOCUMENTS 4,215,329 7/1980 Kobler ..... 335/79
4,730,176 3/1988 Matsuo ..... 335/84

*Primary Examiner*—H. Broome
*Attorney, Agent, or Firm*—Laff, Whitesel, Conte & Saret

[57] ABSTRACT

A relay has an elongated rocking armature which is mounted on a coil assembly having a centrally located fulcrum about which the armature seesaws. The coil assembly nests in, and is supported by an insulating mounting block. A cover fits over the entire assembly and extends far enough beyond the bottom of the mounting block to form a retaining wall for receiving a sealant which may be poured therein and which thereafter solidifes. The sealant flows through holes in the mounting block and locks the coil assembly in place by integrally joining the block and coil assembly. Arms are formed on the four corners of the armature assembly, immediately over cantilever electrical contact springs. As the armature rocks, the arms affect the vibrations of the cantilever spring. That is, when the springs flex in a direction away from the arms, the effective vibrating length is the entire length of the springs. When it flexes toward the arms, the effective vibrating length is in the order of a half of the entire spring length.

9 Claims, 11 Drawing Sheets

ELECTROMAGNETIC RELAY

BACKGROUND OF THE INVENTION

This invention relates to an electromagnetic relay of a flat configuration which can switch electric contacts by producing a seesaw movement of an armature.

DESCRIPTION OF THE PRIOR ART

Electromagnetic relays of this type are described in U.S. patent application Ser. No. 07/198,476 (corresponding to Japanese Patent Application No. 137,265/1987) assigned to the same assignee as this invention and in U.S. Pat. Nos. 4,695,813; 4,342,016; and 4,499,442. Each of those relays comprises, as shown in FIG. 1, for example, a coil assembly 100 having a U-shaped core 10 wound with a coil 12 and a permanent magnet 13, a box-like plastic base 300 having stationary contact terminals 30, 31, 32 and 33, an armature assembly 200 integrating an armature 20 and movable contact terminals 221 and 231, and a cover (not shown).

When this relay is to be assembled, the coil assembly 100 is inserted into the base 300 and fixed with an adhesive material, and a coil terminal 113 and coil lead terminals 34 to 36 are connected by such means as welding or soldering. The armature assembly 200 is mounted by fixing hinge springs 222 and 232 on the ends thereof to common terminals 38 and 39. The cover (not shown) is attached lastly. A sealant of insulating resin is filled between the lower surface of the base 300 and the periphery of the internal walls of the cover to complete the assembly of the relay.

The prior art relays are, however, detrimental in that the assembly is cumbersome because adhesive is used for fixing the coil assembly 200 with the base 300. Moreover, the assembly dimensions are unstable because the adhesive strength is affected by environmental changes, particularly by high temperature and high humidity to thereby inconveniently change the operational characteristics of the relay.

Especially, when the adhesive strength weakens, vibration applied to the relay may cause a displacement in the relative positions among the structural elements. For instance, if the coil assembly 100 is displaced downwardly from a predetermined position, as the effective distance between movable contacts 223, 223 and stationary contacts 301, 311, 321, 331 increases beyond a specific value, the contact force decreases below a satisfactory level. Conversely, if the coil assembly 100 is displaced upwardly, the gap between the movable contacts and the stationary contacts while in the open-state decreases to be less than a specific value to decrease dielectric strength between the contacts. If even a slight vibration is applied to the relay while it is in this state, the movable contact springs vibrate to short-circuit the contacts. Such vibration would also lower precision in the relative positions between the coil assembly 100 and the base 300, by a large margin.

SUMMARY OF THE INVENTION

An object of this invention is, therefore, to provide an electromagnetic relay which is free from the above-mentioned disadvantages and which has stable characteristics that are free from the influences caused by fluctuations in the environment or under vibration and which a can secure a high dielectric strength between contacts.

Another object of this invention is to provide an electromagnetic relay which can be assembled simply.

Still another object of this invention is to provide an electromagnetic relay which has a longer life because of the reduction of the contact erosion caused by any arc discharge which may occur when the electric current is cut off.

In order to achieve above objects, the electromagnetic relay according to this invention comprises:

a coil assembly having a U-shaped core wound with a coil, a permanent magnet arranged in a manner to cause at least one of the magnetic poles thereof to contact the core, and a coil spool integrally fixing the magnet and the core;

an armature assembly including an armature having opposite ends which oppose opposite ends of said core, hinge springs for supporting a seesaw movement of both ends of the armature which come to contact with or separate from opposite ends of said core respectively, and movable contact springs cooperating with the seesaw movement of the armature, the armature, the hinge springs and the movable contact springs being integrally fixed with an insulating molded member;

an insulating base having a box-like shape with an opening on the top thereof and including stationary contact terminals which have stationary contacts that are opposed to movable contacts of said movable contact spring and common terminals which are to be connected to one end of said hinge springs respectively, when said coil assembly is placed within said opening and said armature assembly is arranged so that said permanent magnet becomes a fulcrum of the seesaw movement of said armature; and a cover to be placed from above on said insulating base after it is mounted with said coil assembly and armature assembly, the openings of the cover being sealed with sealant.

The electromagnetic relay of this invention is characterized in that the base has on the bottom surface thereof through holes extending outwardly, and projecting reference blocks to determine the reference positions for engagement of the coil assembly, flanges on both ends of said spool are cut off in a shape substantially corresponding to the shape of said reference blocks, projections are provided on at least either one of said inner walls of the base or said flanges of said spool for engaging said base when said coil assembly is inserted from above into said base, and said base and said coil assembly are fixed with a sealant which is poured into the bottom surface of said base in order to creep through the through holes of said base to eventually contact the lower part of said flanges and with said projections for engagement.

Another feature of the electromagnetic relay, according to this invention, lies in that it has a relay structure which is similar to the prior art relay. The insulating molded member of the armature assembly is integrally molded with an arm which projects in the longitudinal direction of said movable contact spring in order to make contact with the surface of the springs on the side where the movable contacts are fixed.

BRIEF DESCRIPTION OF THE DRAWINGS

The above and other objects and features of this invention will be more clearly understood by more detailed description given hereinbelow referring to attached drawings.

In the drawings, the same reference numerals denote the same structural elements.

DESCRIPTION OF THE PREFERRED EMBODIMENT

Figure 1:
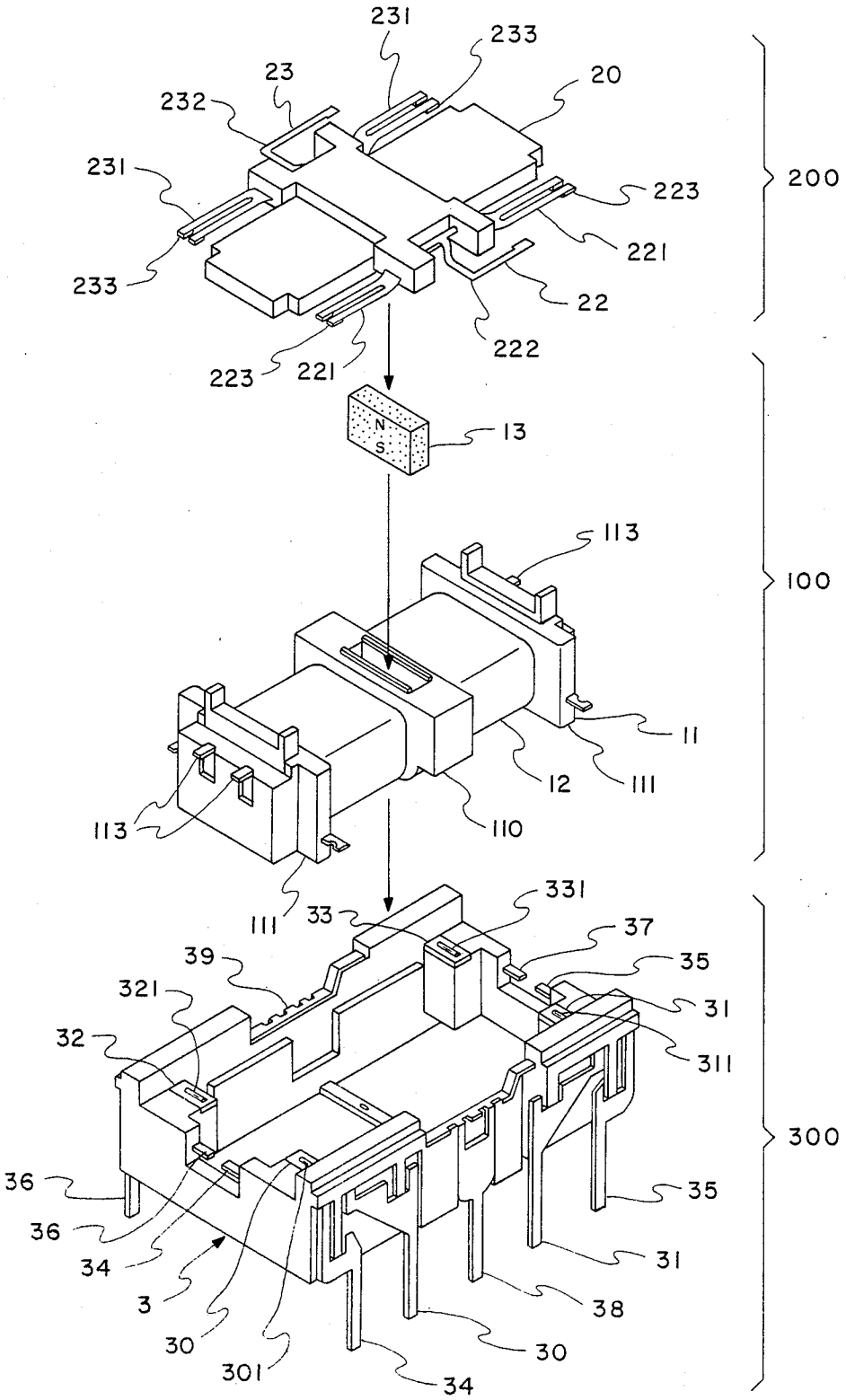
FIG. 1 (PRIOR ART)
FIG. 1 is an exploded perspective view to show the structure of a prior art electromagnetic relay.
Figure 2:
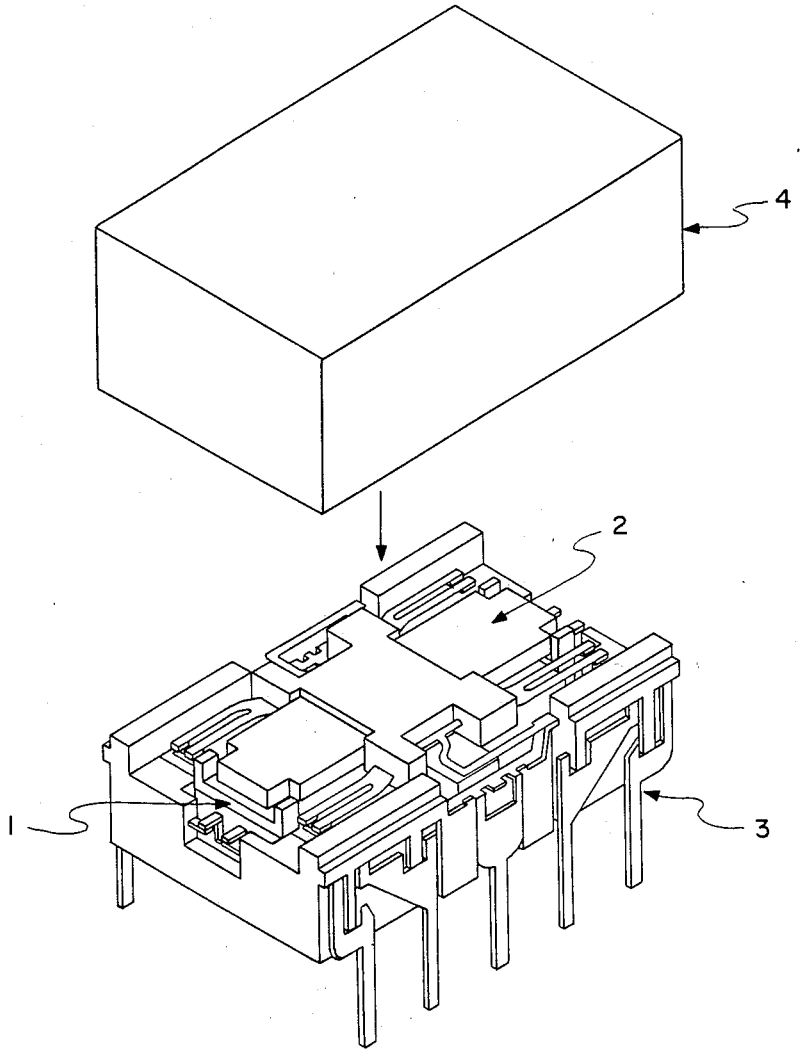
FIG. 2 is a perspective view of an embodiment of this invention.
Figure 3:
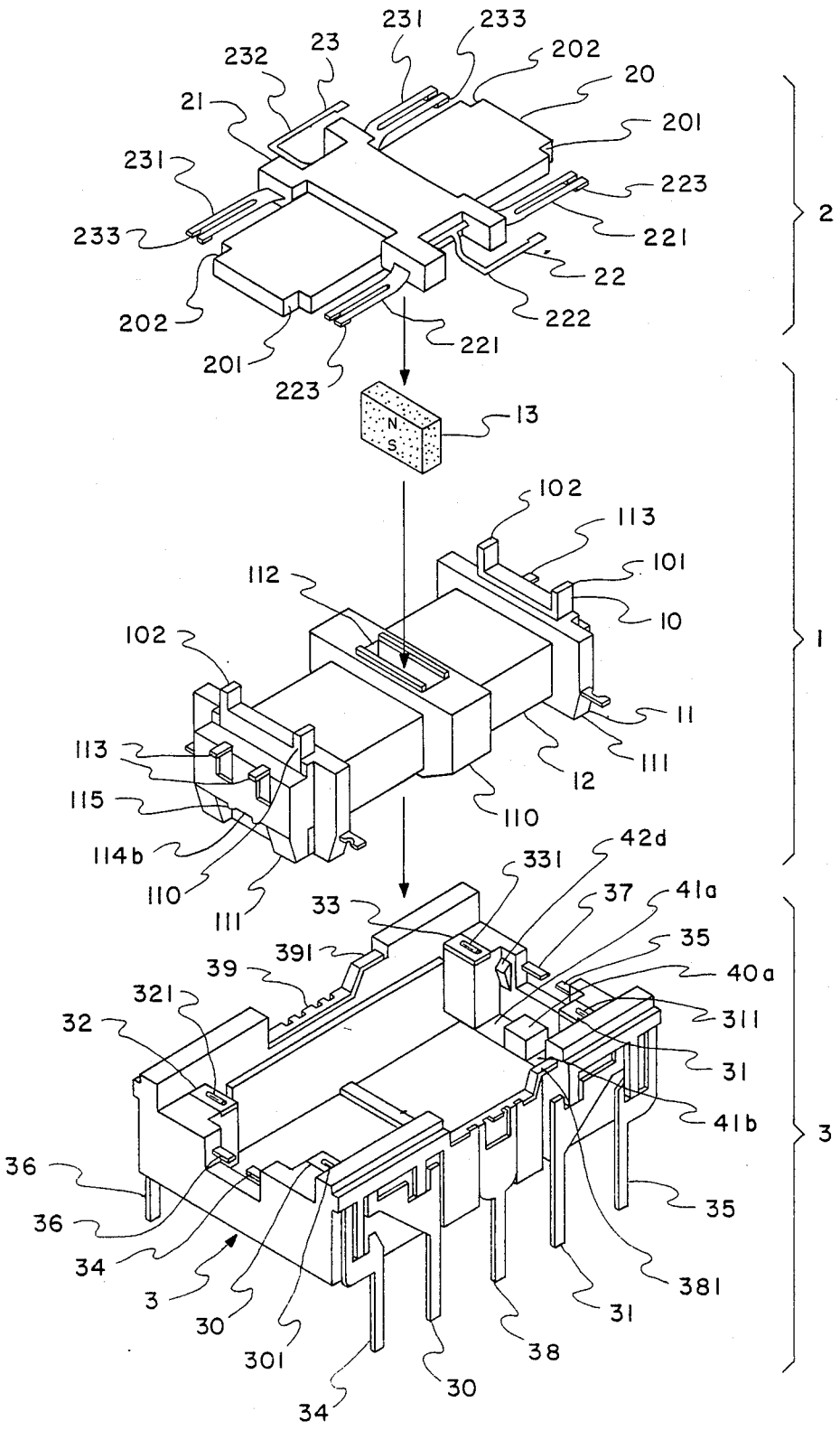
FIG. 3 is an exploded perspective view of FIG. 2.

Referring to FIGS. 2 and 3, an embodiment of the invention comprises a coil assembly 1, an armature assembly 2, an insulating base 3 and a cover 4.

The coil assembly 1 comprises a magnetic core 10 of the shape of a letter U, a coil spool 11 formed by insert-molding the core 10, a coil 12 externally wound around the spool 11, and a permanent magnet 13. Projections 101 and 102 are formed on both sides of the two ends of the U-shaped core 10. The magnet 13 is inserted into a hole 112 of a central flange 110 of the spool 11, and one of the magnetic poles (lower end) is fixed at the center of the iron core 10. Two pairs each of coil terminals 113 are provided on flanges 111 on both ends of the spool 11.

The armature assembly 2 comprises an armature 20 having a flat plate-like form of the magnetic member, an insulating molded member 21 formed by molding the armature 20 at the center thereof, and two electrically conductive spring members 22, 23 respectively provided with movable contact spring sections 221, 231 having movable electric contacts 223 and 233 on both sides and hinge spring sections 222 and 232 of a crank form. Two notches 201, 202 are formed on both ends of the armature 20 in the longitudinal direction so as to correspond to the shapes of the projections 102, 103 of the core 10. The spring members 22, 23 are fixed on both sides of the armature 20. The molded member 21 is made of insulating resin such as a plastic material to integrally hold the armature 20 and spring members 22, 23. The armature 20 is insulated from the members 22 and 23.

The base 3 comprises a flat box-like plastic member with an opening on the top thereof. The base 3 has, at substantially the four corners thereof, four pairs of stationary contact terminals 30 to 33 respectively having electric contacts (stationary contacts) 301, 311, 321, 331, four coil terminals 34 to 37 and two common terminals 38, 39. The coil assembly 1 is fixed internally to the base 3 (described in more detail hereinafter), while the coil terminals 113 of the spool 11 are fixed to the coil terminals 34 to 37 of the base 3 by soldering, etc.

The armature assembly 2 is placed from above so that the center lower surface of the armature 20 comes into contact with the upper magnet pole of the magnet 13. The ends of the hinge spring sections 222 and 232 are mounted by soldering, etc. to the fixing sections 381 and 391 of the common terminals 38 and 39 of the base 3 respectively. When the cover 4 (FIG. 2) is placed from above, the above-mentioned members 1, 2, 3 and 4 form an electromagnetic relay. In this state, the armature 20 can move on the upper end of the magnet 13 upwardly and downwardly due to a seesaw action. The movement is supported with elasticity given by the hinge spring sections 222 and 232 fixed on the common terminals 38, 39 of the base 3 on the ends thereof.

Figure 4A:
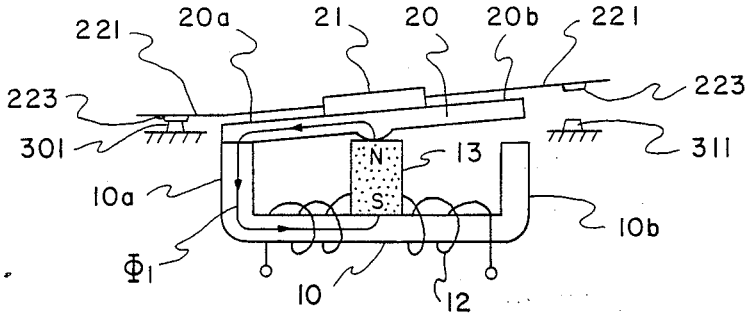
FIGS. 4A to 4C are explanatory, views for stop-motion illustrating the operational principle of the relay of FIG. 2.
Figure 4B:
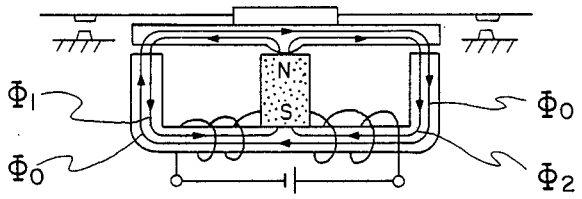

The operational principle of the relay will now be described referring to FIGS. 4A to 4C. As described in the foregoing, a permanent magnet 13 is provided at the center of the inside of the core 10. On both ends 10*a* and 10*b* of the core 10, the ends 20*a*, 20*b* of the armature 20 are positioned to oppose each other in a manner to allow the seesaw movement. In FIG. 4A, showing the state when the coil 12 is not excited, the armature 20 is attracted to the side of the core 10*a* by the magnetic flux $\phi_1$ generated from the magnet 13. In FIG. 4B, showing the state when the coil 12 is excited, the magnetic flux $\phi_0$ generated on the core 10 by excitation overcomes the magnetic flux $\phi_1$ on the side of the armature end 20*a* while the magnetic flux $\phi_0$ is added to the magnetic flux $\phi_2$ of the magnet 13 on the other side of the armature end 20*b*. Therefore, the armature 20 is made to swing clockwise around a fulcrum at the upper end of the magnet 13 to cause the armature end 20*b* and the core 10*b* to contact each other.

Figure 4C:
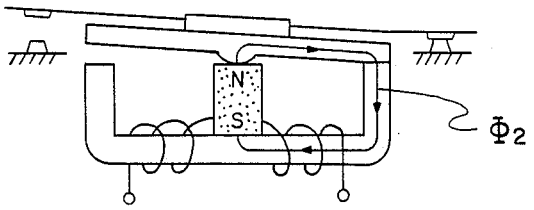

At this state, even if the excitation from the coil 12 is suspended as shown in FIG. 4C, the armature 20 remains attracted toward the core end 10*b* with the magnetic flux $\phi_2$ of the magnet 13. When the direction of the electric current of the coil 12 is reversed, the state is inverted to become that shown in FIG. 4A. The above-mentioned movement indicates a self-holding-type (bistable-type) relay. Since the movable contact springs 221 and 231 are integrally formed with the armature 20 along with the seesaw movement, movable contacts 223 (and 232) and stationary contacts 301, 311 (and 321, 331) come to contact with or become separated from each other to switch electric circuits. Above-mentioned operational principle is analogous to that of the relay disclosed in Japanese Patent Disclosure No. 211,929/1984 assigned to the same assignee as the present invention.

The displacement of the armature 20 on the end which is remote from the core 10 greatly affects the dielectric strength between electric contacts. More particularly, the larger the gap between the armature end and the core end, the larger becomes the dielectric strength. However, as the gap increases, the magnetic reluctance increases to increase leakage flux on the attraction side of armature 20 when the armature state is about to be inverted. This induces a drastic drop of magnetic attraction force. The resulting insufficient magnetic attraction reduces the sensitivity of the relay.

Figure 5A:
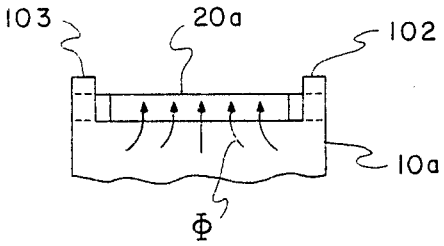
FIGS. 5A and 5B are views to show the contact state and separation state between the armature and the iron core end shown in FIG. 3.
Figure 5B:
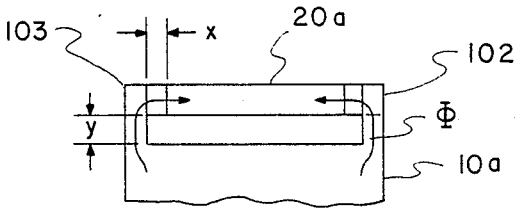

The problem is solved in this embodiment by the provision of the notches 201, 202 (FIG. 3) of the armature 20 and the projections 101, 102 of the core 10. More particularly, in the structure of this embodiment, when the armature end 20*a* makes contact with the core end 10*a* (FIG. 5A), the magnetic flux $\phi$ passes through the lower side of the end 20*a* (contact surface) where the magnetic reluctance is minimum. When the armature end 20*a* is separated from the core end 10*a* (FIG. 5B), the magnetic flux $\phi$ is likely to pass from projections 101, 102 to the side of the end 20*a*. Even when the armature end 20*a* is separated from the upper surface of the core end 10*a* (contact surface), the gap x does not change between the side surface of the armature end 20*a* and the projections 101, 102 which act as side yokes. Therefore, a path of the magnetic flux $\phi$ is constantly secured to reduce leakage flux. Even if the gap y is large (in other words, the dielectric strength is large), the magnetic attraction force is prevented from drastically decreasing when the armature state is inverted. As a result, a relay can be realized with higher sensitivity and larger dielectric strength between contacts.

A description will now be given to the engagement of the base 3 with the coil assembly 1 referring to FIGS. 6A, 6B, 7A and 7B.

Figure 6A:
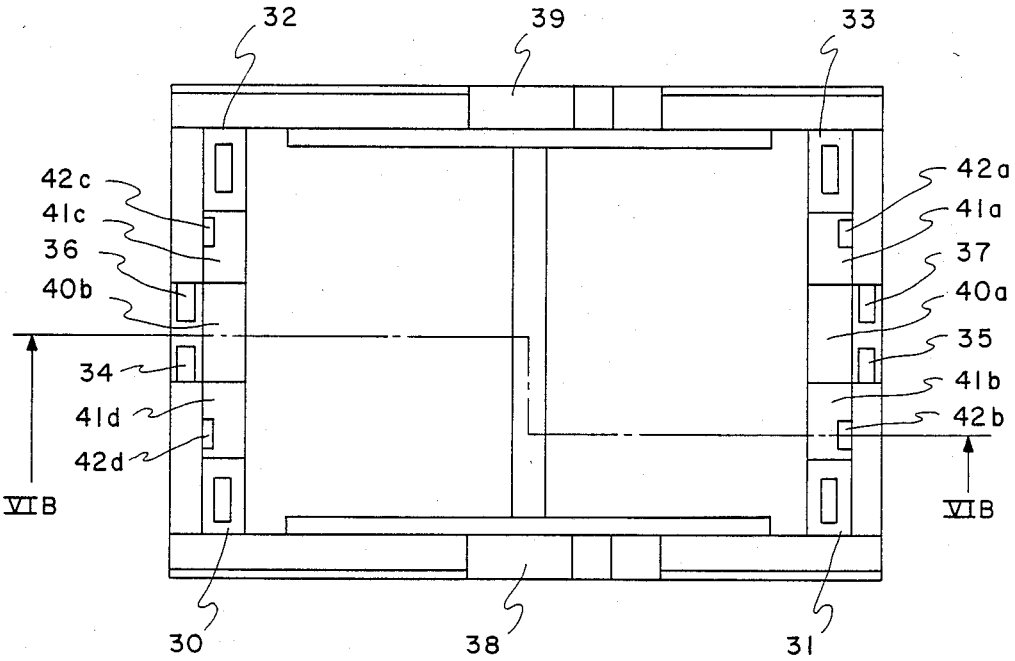
FIGS. 6A and 6B are a plan view and a cross sectional view along the line VIB (FIG. 6A) of the base shown in FIG. 3, respectively.
Figure 6B:
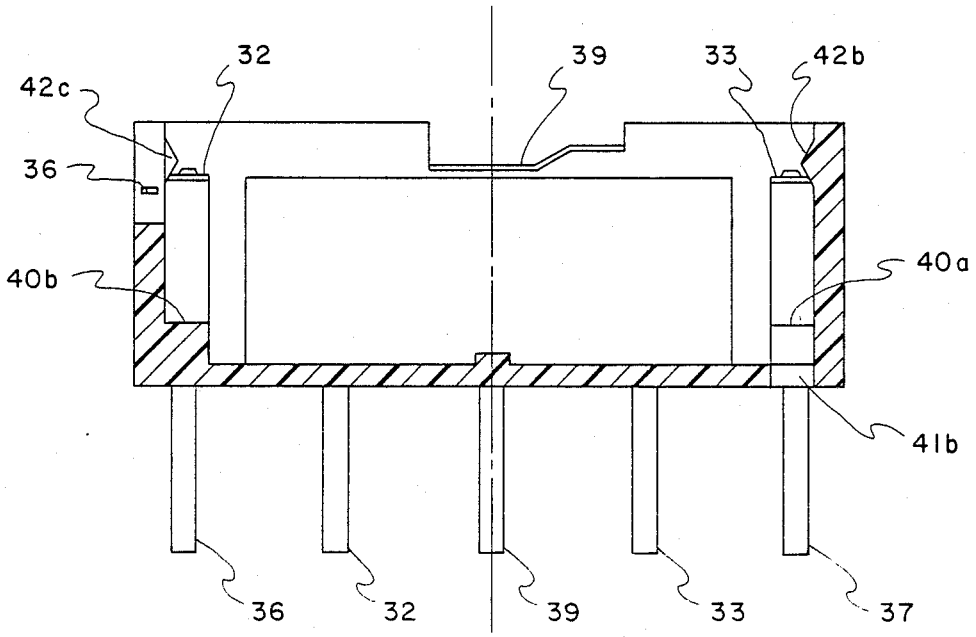

As shown in FIGS. 6A and 6B, reference blocks 40*a* and 40*b* for positioning the coil assembly 1 are internally provided, one each on both longitudinal ends of the bottom of the base 3. On both sides of the reference block 40*a* are formed one each hole 41*a*, 41*b* while on both sides of the reference block 40*b* are formed one each hole 41*c*, 41*d*. These holes 41*a*, 41*b*, 41*c* and 41*d* are through holes extending beyond the bottom of the base 3. Projections 42*a*, 42*b*, 42*c* and 42*d* are formed on the internal walls of the base 3, above the respective holes 41*a* to 41*d*, for engaging and fixing the coil assembly 1. Each of these projections 42*a* to 42*d* has a triangle shape which is tapered. The upper tapered sides of projections 42*a*–42*d* facilitates an assembly of the coil assembly 1 into the base 3 while the lower tapered side firmly presses the coil assembly 1 onto the base 3.

Flanges 111 (FIG. 7A) on both sides of the spool 10 of the coil assembly 1 have cut off portions 114*a* and 114*b* (FIGS. 3 and 7B) corresponding to the shapes of the reference blocks 40*a* and 40*b* of the base 3, respectively. On the upper faces of the cut off portions 114*a* and 114*b* are formed rail-like projections 115 extended along the upper faces. The projections 115 may be formed on the blocks 40*a* and 40*b*.

When the coil assembly 1 of this structure is to be inserted into the base 3, tapered side portions provided at four positions below both sides of the flanges 111 (i.e., on both sides of cut off portions 114*a*, 114*b*) fit neatly with the upper tapered portions of the projections 42*a* to 42*d* of the base 3 to allow smooth insertion. When the coil assembly 1 (FIG. 3) is further pushed in, the four corners of the spool 11 become fitted in below the lower tapered side portions of the projections 42*a* to 42*d* (see FIGS. 7A and 7B). Simultaneously, the reference blocks 40*a* and 40*b* are engaged with the cut off portions 114*a* and 114*b* of the spool 10 while the projections 115 become firmly abutted onto the reference blocks 40*a* and 40*b* to become deformed and secure the dimensional precision of the coil assembly 1 in vertical direction at target values.

Figure 7A:
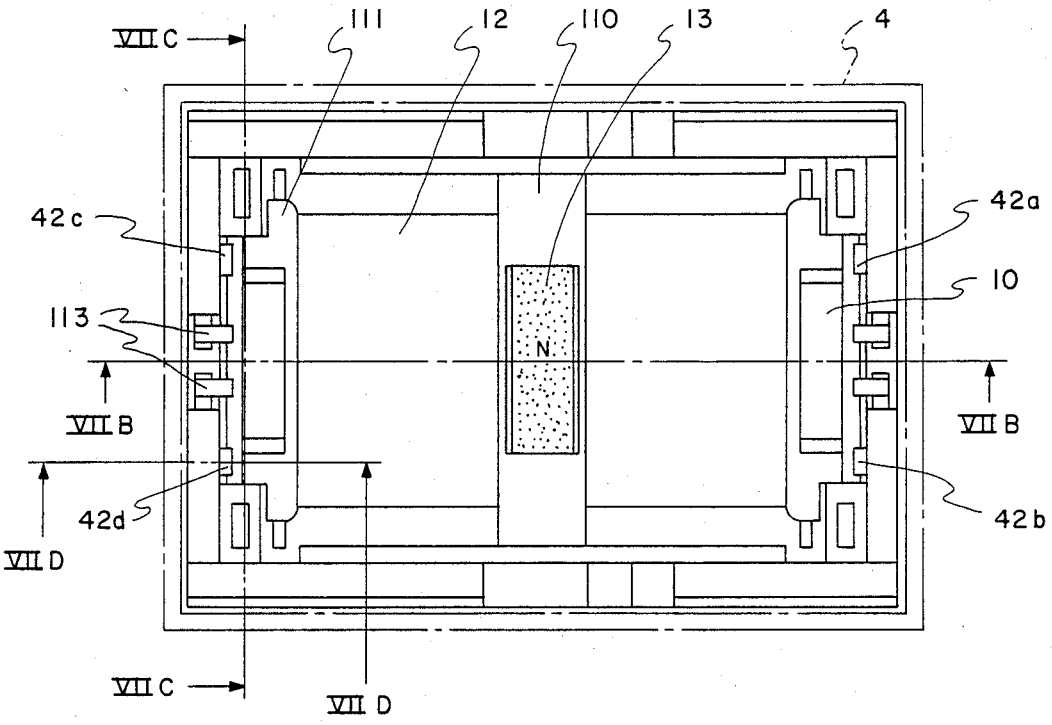
FIGS. 7A to 7D are a plan view, a cross sectional view along the line VIIB (FIG. 7A), a cross sectional view along the line VIIC and a cross sectional view along the line VIID of the base and the coil assembly shown in FIG. 2, respectively.
Figure 7B:
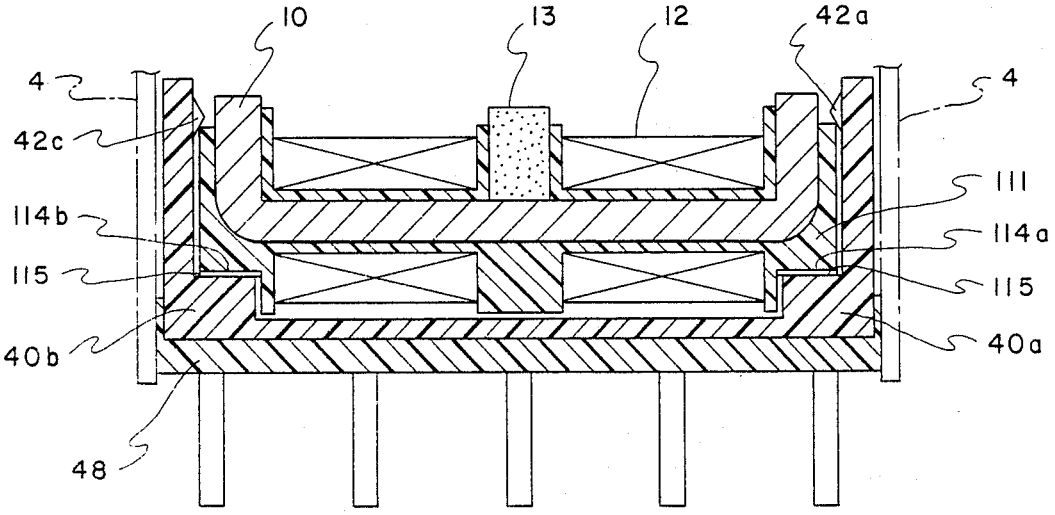
Figure 7C:
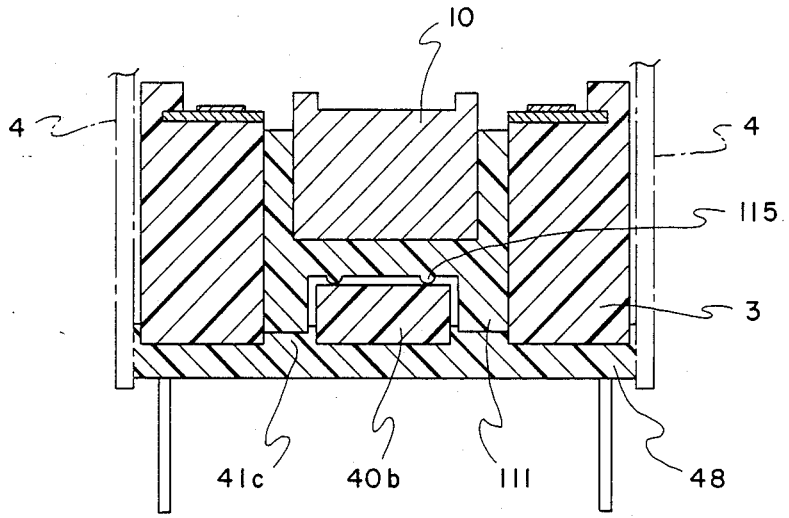
Figure 7D:
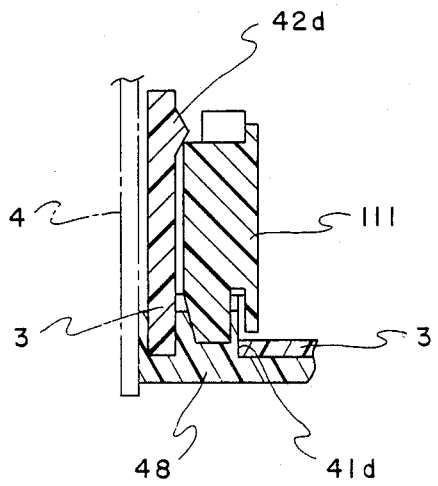

Subsequently, the armature assembly 2 (FIG. 3) is placed in a manner mentioned above. Then the cover 4 is placed from above and a sealant 48 of insulating resin is filled into the gap formed between the bottom of the base 3 and the periphery of the cover 4. The sealant 48 creeps through the holes 41*a* through 41*d* (FIGS. 6A, 7C, 7D) into the base 3 to contact the lower ends of the flanges 111. As a result, when the sealant 48 is set, the spool 11 (i.e., the coil assembly 1) is fixed to the base 3 (see FIGS. 7C and 7D). In this manner, the coil assembly 1 and the base 3 are fixed fully even without the adhesive material mentioned on the prior art relay, because the assembly 1 and the base 3 are fixed by two kinds of forces caused by the sealant 48 and by the pressure due to the projections 42*a* to 42*d*. As a result, when the coil assembly 1 is inserted unidirectionaly (from above) and sealed in an ordinary manner, the coil assembly 1 is firmly fixed to the base 3 to markedly facilitate the assembly procedure.

Figure 8:
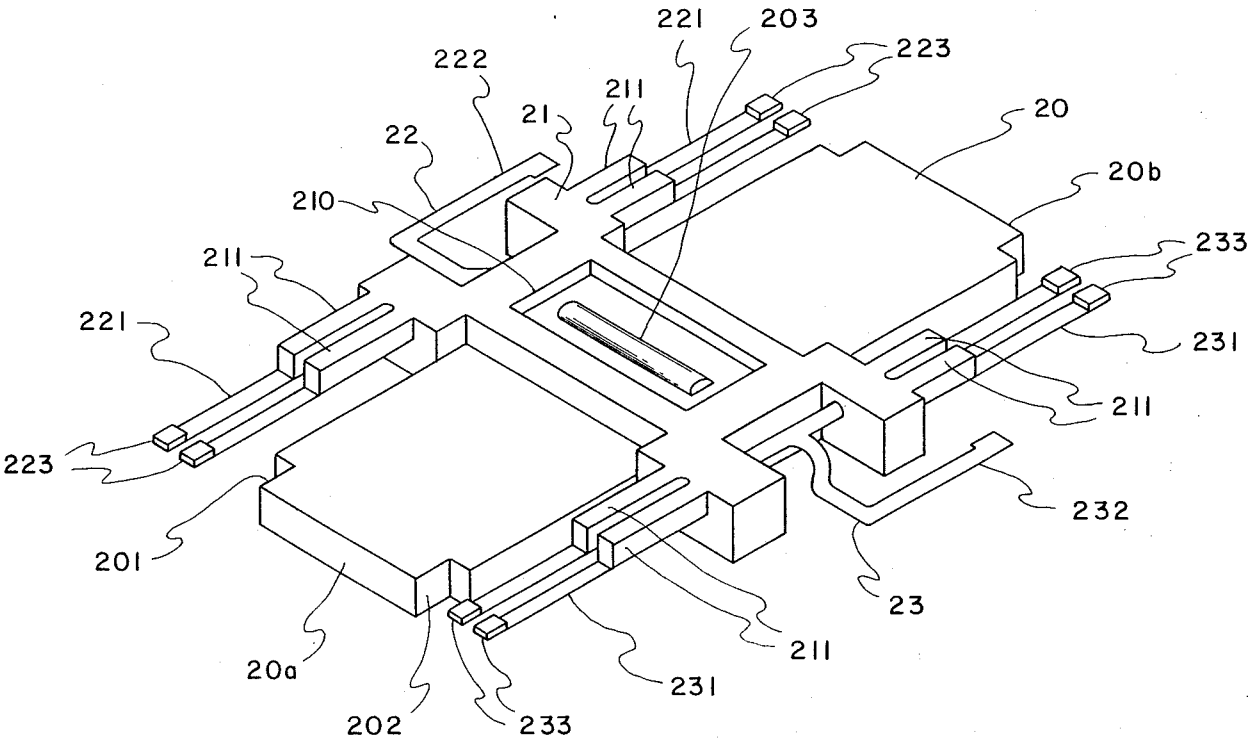
FIG. 8 is a perspective view to show the details of the armature assembly shown in FIG. 3.

The armature assembly 2 will now be described in more detail, referring to FIG. 8. The hinge springs 222 and 232 both support the seesaw movement of the armature assembly 2 and make electrical contact with the movable contacts 223 and 233 of the movable contact springs 221 and 231. Thus, the hinge springs 222 and 232 can act as common terminals for the transfer switching contacts. The the hinge springs 222 and 232 are formed in the shape of a crank and are exposed before the cover is placed from above. Therefore, they can be adjusted for optimal loads even after assembly simply by bending them.

A window 210 is formed on the lower surface of the molded member 21 to expose the lower central surface of the armature 20. Within the window 210 is formed a supporting projection 203 by press-working the armature 20. The projection 203 is encircled by the molded section 21 and comes in contact with the magnet 13 to become a supporting fulcrum or point for the movement of the armature 20. The molded member 21 prevents powders which are generated by frictional movement from reaching the electric contacts. This eliminates an adverse effect on said contacts which may otherwise be caused by the generated powders (insulator) resulting from friction in order to attain higher reliability in the relay.

A portion of the molded member 21 projects in the longitudinal direction of contact springs 221 and 231 to form arms 211 which contact the bottom surfaces of the springs 221 and 231 (surfaces on the sides of the electric contacts 223 and 233). As the arms 211 is formed by insert-molding of the armature assembly 2, it does not apply pressure on the contact springs 221 and 231 but it simply stays in contact with them. Therefore, the arms 211 will not influence spring load characteristics thereof and yet can reduce spring vibrations of the springs 221 and 231.

Figure 9A:
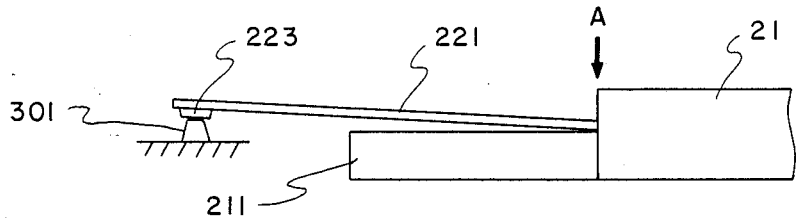
FIGS. 9A and 9B are side views to show the movement of an armature assembly shown in FIG. 8.

A description will now be given as to the effect of the arms 211, referring to FIGS. 9A and 9B. FIG. 9A shows the state where contacts are closed. More specifically, the stationary contact 301 and the movable contact 223 are in contact with each other. The contact spring 221 is flexed and displaced upwardly on in the opposite direction (away from the arm 211) to cause the movable contact 223 to exert the contact force. Since an interspace is formed between the arm 211 and the contact spring 221, the end of the contact spring is fixed at the point A. No and there is no significant difference is produced in characteristics from the case without the arm 211.

Figure 9B:
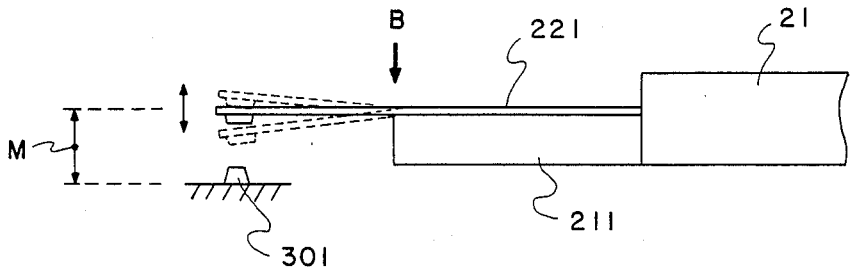
Figure 10:
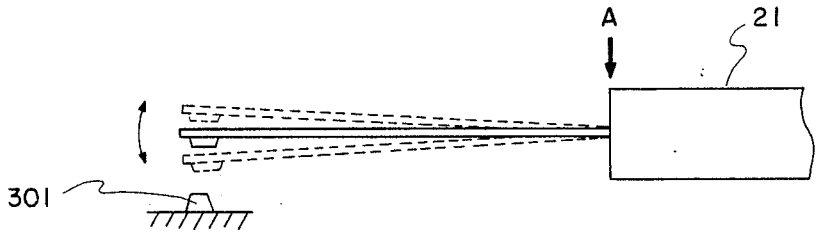
FIG. 10 (PRIOR ART)
FIG. 10 is a side view to show the operation of the prior art armature assembly shown in FIG. 1.

FIG. 9B shows the state where the two contacts 223 and 301 are separated. In this state, the vibration of the contact spring 221 is decreased in amplitude because arm 211 moves the fulcrum of the vibration to the point B. At the same time, an attenuation time of the vibration is remarkably decreased. As shown in FIG. 10, the fulcrum of the vibration by the contact spring 221 in the prior art is at the point A during the time of transition to the open state, the amplitude and attenuation of the vibration are usually large.

As described in the foregoing statement, according to this invention even if the relay is vibrated, the vibration on the contact springs 221 and 231 can be restricted to keep the gap M (FIG. 9B) between contacts at a large value, and hence to maintain the dielectric strength between contacts 223, 301 at a high value. In the prior art structure shown in FIG. 10, in addition to the free vibration occurring on the cantilevered spring, since additional vibration is produced by the impact of the armature 20 on the opposite side against the end of the core 10 (i.e., on the side where contacts are closed), an arc discharge may be produced at the break of current. The arc tends to continue to accelerate the wear of contacts. However, in this embodiment, due to the effect of the arm 211, the vibration applied on the spring whenever contacts are switched is rapidly attenuated to remarkably prevent the wear on the contact otherwise produced by an arc discharge, which greatly contributes to extend life of the relay.

Figure 11:
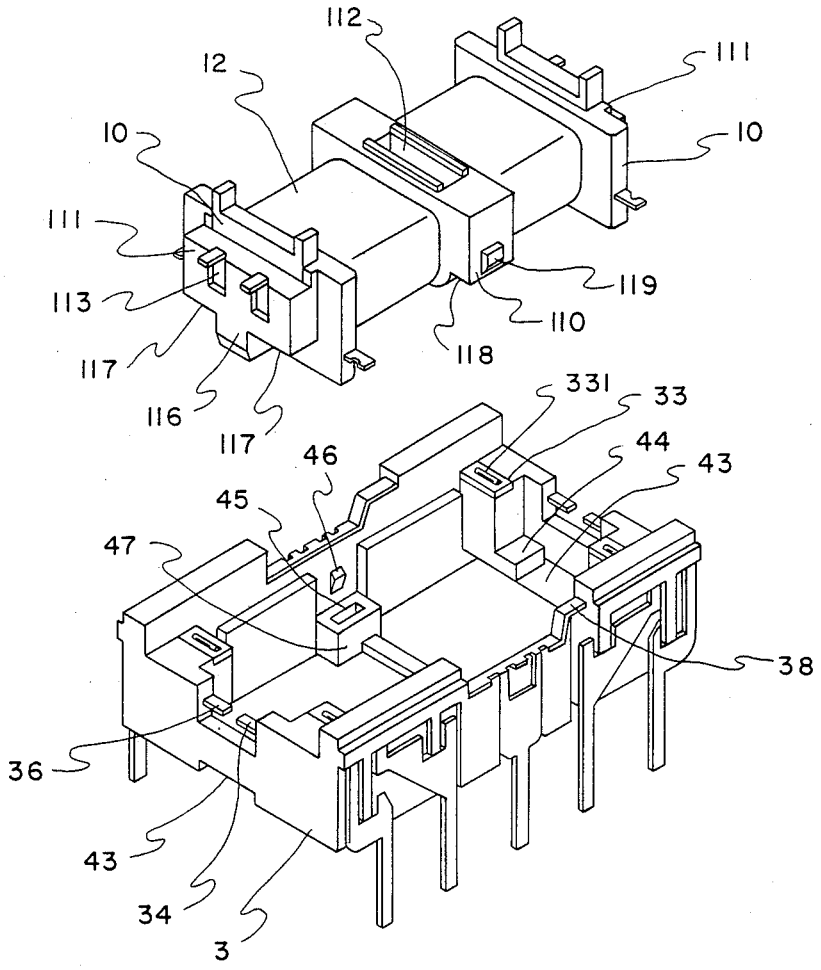
FIG. 11 is a modification of the engagement construction of the base and the coil assembly shown in FIG. 2.

Referring to FIG. 11, a modified engagement of the base 3 with the coil assembly 1 is described. In this embodiment, cut off portion 117 is provided on the lower surfaces of both sides of the flanges 111 of the spool 10 of the coil assembly 1 to form projections 116. Through holes 43 are formed one each on both sides of the base 3 for engagement with the projections 116. On both sides of the holes 43 are provided reference blocks 44 in a shape corresponding to the cut off portions 117 of the coil assembly 1.

In the flange 110, at the center of the coil assembly 1, are formed projections 119 on both sides and cut off portions 118 on the lower surface thereof. The base 3 is provided on the center of the side walls with projections 46 to fit with the projections 119, and projections 47 to fit with the cut off portions 118. The projections 47 have through holes 45 extending to the outside of the base 3 so as to allow the creepage of the sealant 48 therethrough, from the bottom of the base 3, in order to reach the projections 119. This further reinforces the firm engagement of the coil spool 10 (i.e., the coil assembly 1) with the base 3. The effect of the fixation with the sealant 48 is similar to the above when it is used for fixing the projection 116 of the coil spool 10 with the hole 43 of the base 3.

Figure 12A:
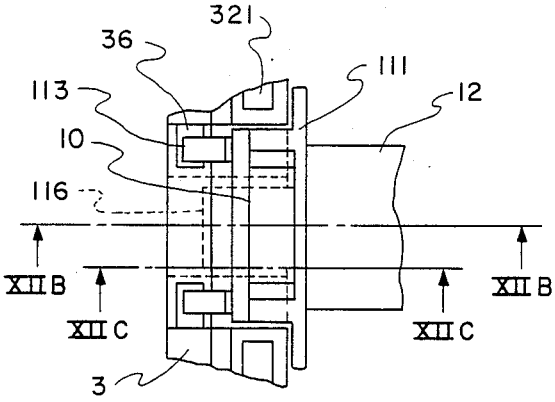
FIGS. 12A to 12C, 13A and 13B are explanatory views to illustrate the engaged state of respective parts shown in FIG. 11.
Figure 12B:
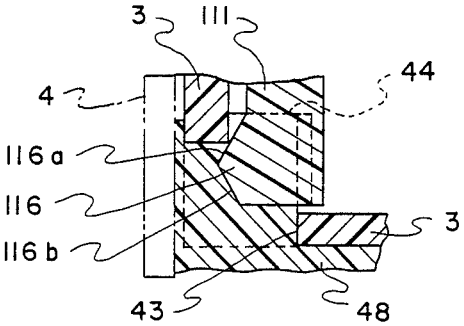
Figure 12C:
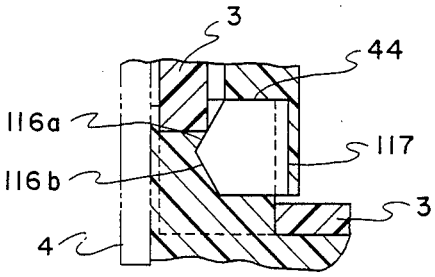

FIGS. 12A to 12C show the engagement of the coil assembly 1 on both ends in the longitudinal direction. The upper surface of the reference blocks 44 of the base 3 and the lower surface of the cut off portions 117 of the coil assembly 1 are used as the reference for assembly. By abutting these two surfaces onto each other, the slope of the upper tapered surface **116*a* provided on the projection 116 may come to contact and engage with the inner walls of the base 3. The projection 116 is tapered at two positions, the upper one of which is used for engagement and the lower one of which is used as a guide for insertion in the hole 43**.

After mounting the cover 4, the sealant 48 is filled in the gap between the periphery of the cover walls and the lower surface of the base 3. The sealant 48 flows into the holes 43 to contact the projections 116, which further enhances the engagement.

Figure 13A:
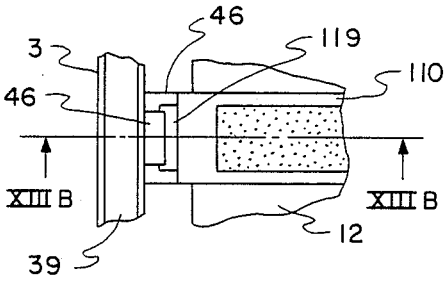
Figure 13B:
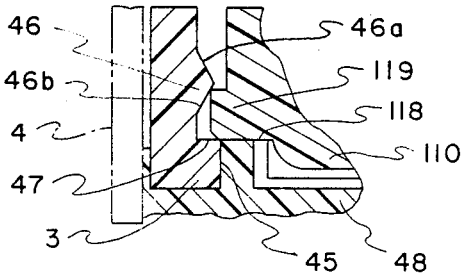

FIGS. 13A and 13B show the engagement of the coil assembly 1 with the base 3 on the center side. The surface of the cut off portion 118 and the upper surface of the projection 47 of the base 3 are used as the reference. The projections 46 and 119 are abutted against these two surfaces for engagement.

In the above embodiments of this invention, all the reference used are upper surfaces of the reference blocks projected from the bottom of the base 3. This is because it would reinforce the strength of the reference surfaces to further stabilize the dimensional precision. This allows the thickness of the other parts of the base 3 to be reduced and thus greatly contributes to minimization of the relay height.

What is claimed is:

1. An electromagnetic relay comprising:

a coil assembly including a U-shaped core having opposite ends and wound with a coil, a permanent magnet arranged in a manner to cause at least one of the magnetic poles thereof to contact the core, and a coil spool integrally fixing the magnet and the core;

an armature assembly including an armature having opposite ends confronting said opposite ends of said core, hinge springs for supporting said armature with a seesaw movement of both ends of the armature which come into contact with or separate from both ends of said core respectively, and movable contact springs cooperating with the seesaw movement of the armature; the armature, the hinge springs and the movable contact springs being integrally fixed together by an insulating molded member;

an insulating base having a box-like shape with an opening on the top thereof and including stationary contact terminals which have stationary contacts opposed to movable contacts of said movable contact spring and common terminals to be connected to one end of said hinge springs respectively, when said coil assembly is placed within said opening and said armature assembly is arranged in a manner so that said permanent magnet becomes a fulcrum of the seesaw movement of said armature; and a cover placed from above on said insulating base after said armature assembly is mounted on said coil assembly, and space formed between the bottom surface of the base and periphery of the internal wall of the cover being sealed with sealant; and the relay being characterized in that said insulating molded member of the armature assembly integrally has an arm which extends in the longitudinal direction of said movable contact springs to contact the surfaces thereof on the side where the movable contacts are fixed.

2. The electromagnetic relay as claimed in claim 1, wherein the bottom surface of said base has through holes formed therein and further is formed with projecting reference blocks which are used to determine the reference position for engagement of said coil assembly, flanges on both sides of said spool being formed in a shape substantially corresponding to the shape of said reference blocks, projections formed on at least one of the internal walls of said insulating base and the flanges of said spool for engaging said base when said coil assembly is inserted from above into said base, and said base and said coil assembly being fixed with a sealant which is poured into the bottom surface of said base to creep through the through holes to make contact with the lower portions of said projections for engagement.

3. The electromagnetic relay as claimed in claim 1, wherein at least one projection is formed respectively on each end of said core, and cut off portions are made on both ends of said armature corresponding to the shapes of the projections of the core.

4. An electromagnetic relay comprising:

a coil assembly having a U-shaped core with opposite ends and being wound with a coil, a permanent magnet arranged in a manner to cause at least one of the magnetic poles thereof to contact the core, and a coil spool integrally fixing the magnet and the core;

an armature assembly including an armature having opposite ends at locations which oppose both ends of said core, hinge springs for supporting said armature assembly with a seesaw movement where both ends of the armature come to contact with or separate from both ends of said core respectively, and movable contact springs cooperating with the seesaw movement of the armature; the armature, the hinge springs and the movable contact springs being integrally fixed with an insulating molded member;

an insulating base having a box-like shape with an opening on the top thereof and including stationary contact terminals which have stationary contacts opposed to movable contacts of said movable contact spring and common terminals to be connected to one end of said hinge springs respectively, when said coil assembly is placed within said opening and said armature assembly is arranged in a manner so that said permanent magnet becomes a fulcrum of the seesaw movement of said armature; and a cover placed from above on said insulating base after said coil assembly and armature assembly is mounted on said base, space formed between the bottom surface of the base and periphery of the internal wall of the cover being sealed with sealant;

the relay being characterized in that said base has on the bottom surface thereof through holes extending outwardly and projecting reference blocks on the base to determine the reference positions for engagement of the coil assembly, flanges on both ends of said spool being cut off in a shape corresponding substantially to the shapes of said reference blocks, projections formed on at least one of the internal walls of said insulating base and the flanges of said spool for engaging said base when said coil assembly is inserted from above into said base, and said base and said coil assembly being fixed with a sealant which is poured into the bottom surface of said base to creep through the through holes in order to make contact with the lower portions of said flanges and with said projections for engagement.

5. The electromagnetic relay as claimed in claim 4, wherein said projections for engagement are provided on four portions of the inner walls of said insulating base in a manner to abut onto the four corners of said spool, and rail-like projections further provided on either the reference blocks of said base or said cut off portions of said spool, said projections being in a form which is deformable by pressure.

6. The electromagnetic relay as claimed in claim 4, wherein said projections for engagement are provided on both flanges of said spool, the projections being engaged with said through holes of the base, second projections for engagement being formed on both sides of a central flange, said second projections extending in the longitudinal direction, and said base having third projections for engagement with said second projections, and second holes extending through said base to the lower surface of said base so that said sealant which creeps through said second through holes may come in contact with said third projections for engagement.

7. A relay comprising an elongated armature assembly having a centrally located means for mounting said armature for a seesaw motion about a fulcrum, an elongated coil assembly centrally providing said fulcrum for supporting said armature mounting means to enable and cause said seesaw motion, an insulating mounting block for holding said coil assembly, complimentary and confronting contacts on opposing ends of said elongated armature assembly and said insulated mounting block for opening and closing electrical circuits responsive to said seesaw motion, and cover means fitting over said insulating mounting block and extending far enough beyond said insulating mounting block to form a retainer wall for receiving a sealant which may be poured therein, said coil assembly and said insulating mounting block having complementary shapes and openings so that said sealant penetrates said mounting block and joins said coil assembly and insulating mounting block into an integral unit when the sealant is set, at least one of said complimentary contacts being a cantilever spring mounted on at least one of said armature assembly and said insulating mounting block, and support means extending along one side of said cantilever spring for reducing the effective length of said cantilever spring when it is flexed in the direction of said support means, whereby said cantilever has one effective length when it flexes in one direction and another effective length when it flexes in an opposite direction.

8. The relay of claim 7 wherein said armature assembly is a generally rectangular structure with four corners and there are at least four of said cantilever springs mounted on the respective four corners of said armature assembly, and said armature assembly has at least four arms extending parallel to and along said one side of each said cantilever springs for providing said change in effective length of said cantilever spring flexing.

9. The relay of claim 8 wherein said one side of said cantilever springs is the side which confronts contacts on said insulating mounting blocks.

* * * * *